United States Patent [19]

Allen, Jr. et al.

[11] 4,383,829

[45] May 17, 1983

[54] DRIVE ASSEMBLY FOR INBOARD SPEEDBOAT

[75] Inventors: Harry L. Allen, Jr., Mentor, Ohio; Michael J. Stewart, Bethel Park, Pa.

[73] Assignee: Great Lakes Power Products, Inc., Mentor, Ohio

[21] Appl. No.: 359,295

[22] Filed: Mar. 18, 1982

Related U.S. Application Data

[63] Continuation of Ser. No. 88,135, Oct. 25, 1979.

[51] Int. Cl.[3] ..... B63H 21/26

[52] U.S. Cl. ..... 440/75; 440/66; 440/82

[58] Field of Search ..... 440/4, 49, 51, 53, 58, 440/59, 60–63, 66, 78, 79, 80, 81, 82, 83, 89, 112, 113, 75; 114/56

[56] References Cited

U.S. PATENT DOCUMENTS

| | | | |
|---|---|---|---|
| 1,548,917 | 8/1925 | Vincent | 440/75 |
| 2,242,642 | 5/1941 | Bogert | 440/81 |
| 2,328,939 | 9/1943 | Xiques | 440/79 |
| 3,076,204 | 2/1963 | Nowak, Jr. | 440/83 |
| 3,434,447 | 3/1969 | Christensen et al. | 440/66 |

FOREIGN PATENT DOCUMENTS

| | | | |
|---|---|---|---|
| 74080 | 10/1948 | Norway | 440/75 |
| 325852 | 2/1930 | United Kingdom | 440/82 |

*Primary Examiner*—Charles E. Frankfort
*Assistant Examiner*—Jesús D. Sotelo
*Attorney, Agent, or Firm*—Baldwin, Egan, Walling & Fetzer

[57] ABSTRACT

A high performance speedboat with a planing type hull and incorporating a drive mechanism having a one or two-speed-forward, step-up, V-gear, hydraulic transmission, which connects the engine drive shaft and the propeller shaft in V-drive structure. The propeller shaft extends rearwardly through the boat transom to provide a "thru-drive" system in coaction with a unitary strut and stern steering support assembly for placement on the boat transom. Such assembly includes a planar transom member secured to the boat transom, and a rearwardly extending, generally horizontal, planar structural member secured to the transom member and extending rearwardly of the boat. The structural member is bifurcated and has a pair of spaced rear end portions having rudder support means operatively disposed thereon for receiving rudder assemblies therein. Also provided is a pair of spaced strut support members secured to the assembly and extending downwardly therefrom with each having a propeller shaft support. A pair of elongated open-ended tubes may be disposed on the stern of the boat and extend through the structural member with their lower ends spaced slightly from the propellers and with their upper ends extending above the waterline. When the boat is in acceleration mode, air is drawn from the atmosphere and down the tubes to the propellers and into the propeller stream by the action of the propellers to control cavitation and reduce the torque required to accelerate the propellers. The tubes have valves to control air flow therethrough.

1 Claim, 14 Drawing Figures

DRIVE ASSEMBLY FOR INBOARD SPEEDBOAT

This is a continuation of application Ser. No. 88,135, filed Oct. 25, 1979.

This invention relates to a drive assembly for a high-performance inboard speedboat and more particularly to a marine drive assembly incorporating a one or two-speed-forward, step-up, V-gear, hydraulic transmission and including a unitary strut and stern steering support assembly having controlled air flow means to the propeller to control the amount of cavitation. The invention is adapted for motorboats of the type having built-in power plants commonly called "inboard" motorboats in contradistinction to "outboard" motorboats.

BACKGROUND OF THE INVENTION

In recent years, the trend in power or high speed motorboat design has been toward the establishment of high speed planing hulls as distinguished from slow, displacement hull designs. It has been found that in high speed planing hull designs, it is desirable and highly beneficial to place the mass of the engine in the rear of the hull above the planing surface. Placing the engine aft requires that a suitable drive train be provided between the engine at the rear of the boat to the forward, inboard end of the propeller shaft. To facilitate placement of the engine in the rear, the art has developed what has become known as marine V-drives. A marine V-drive enables the engine to be installed in the stern of the boat with the engine shaft line and the propeller shaft line intersecting in substantially an acute angle, at which point of intersection intermeshing transmission gears have been provided for the transmission of rotary motion from the engine to the vessel propeller.

However, there has long been a need in V-drive high-performance inboard planing-type speedboats for a better match of engine output to hull load and configuration, over the planing speed range. In this regard, the engine drive assembly is most critical. Prior marine drive train structures contain many deficiencies. For example, in most prior drive train structures, the propeller shaft extends through the hull at a considerable angle to the horizontal, with the result that substantial vertical forces are produced that tend to lift the boat, such vertical forces not contributing to the forward motion of the boat. Most speedboats incorporate step-down transmissions which are relatively inefficient for high performance marine device structures. If high-powered engines (such as for example, lower speed diesel engines) are used to achieve high boat speed, propeller stream cavitation makes it difficult, if not impossible, to accelerate the propellers to planing speeds when using step-up (or speed increase) marine transmissions.

Additionally, prior inboard motorboats have individual stern mounting constructions for the propeller shaft and for the steering (rudder) structure. There has long been a need for a simple, unitary, one-piece strut and stern steering support assembly that may be inexpensively manufactured and easily placed on the transom of an inboard motorboat.

When the boat is in sitting position in the water, its attitude or angle to the horizontal is relatively pronounced due to the weight concentration aft, such sitting position being referred to as the "in-the-hole-position". When power is applied and the boat slowly gets underway, difficulty is experienced in getting the boat "out-of-the-hole".

In a V-drive configuration, weight distribution dictates boat attitude. More weight aft results in more difficult and higher transition speed (displacement to planing), but higher top speed due to decreased wetted surface.

Controlled propeller cavitation provides two features:

1. Ability to accelerate surface-piercing, super-cavitating large blade area propellers in displacement mode; and 2. More efficient propulsion at high speeds by utilizing the energy of imploding air bubbles in conjunction with a surface-piercing, super-cavitating large blade area propeller.

Controlled cavitation enables the acceleration of the engines to their maximum output torque capability, thereby increasing the size and type of propeller to maximize top vessel speed.

Therefore, it is an object of the invention to provide a high-performance speedboat with a planing type hull incorporating a drive mechanism having at least one speed forward, step-up, V-gear hydraulic transmission with the propeller shaft extending rearwardly through the boat transom to provide a "thru-drive" system.

A further object of the invention is to provide a "thru-drive" system of the above type having a one-piece, unitary propeller strut and stern steering support assembly mounted on the boat transom capable of easy mounting, removal and replacement.

A further object of the invention is to provide a "thru-drive" power mechanism having a one-piece unitary propeller strut and stern steering support assembly of the above type which is capable of easy manufacture, assembly, maintenance, inspection and repair because of simplicity of structure.

A further object of the invention is to provide a "thru-drive" system of the above type incorporating means to control propeller cavitation and thus expeditiously bring the boat "out-of-the-hole" and up to cruising speed.

A further object of the invention is to provide a "thru-drive" system of the above type effecting a relatively flat propeller shaft angle when the boat reaches cruising speed whereby the propelling force upon the water is in a direction substantially parallel with the longitudinal axis of the boat.

BRIEF DESCRIPTION OF THE INVENTION

Briefly, the foregoing objects are accomplished by the provision of a high performance speedboat with a planing type hull and incorporating a drive mechanism having at least one speed forward, step-up, V-gear, hydraulic transmission, which connects the engine driveshaft and the propeller shaft in V-drive configuration. The transmission may be a one or two speed (or more) forward step-up transmission with or without a reverse gear. The propeller shaft extends aft through the boat transom to provide a "thru-drive" system in coaction with the above-described drive train and in coaction with a unitary strut and stern steering support assembly for placement on the boat transom. The unitary strut and stern steering support assembly includes a transom member which is bolted to the boat transom, an elongated planar structural member (having bifurcated end portions with rudder assemblies thereon) welded to the transom member intermediate its top and bottom edges and extending rearwardly therefrom, and a pair of spaced strut support members secured to the structural member and extending downwardly therefrom and having propeller shaft support means on their lower ends for operatively receiving propeller shafts therein. A pair of spaced reinforcing members is secured to the structural member and to the transom member for reinforcing the juncture of such latter members.

To control cavitation, a pair of elongated, open-ended, generally vertical tubes are provided on the stern of the boat which extend through at least a part of the structural member with their lower ends spaced slightly from the propellers and with their upper ends extending above the waterline. When the boat is in displacement operation, air is drawn from the atmosphere and down the tubes to the propellers and into the propeller stream by the action of the propellers to control propeller stream cavitation. The tubes have air-flow control valves at their top ends to control the flow of air through the tubes.

In operation, the boat is initially brought up to a speed of six to twelve miles per hour at which speed the boat is still "in-the-hole". To get the boat "out-of-the-hole", the tube air-flow control valves are opened permitting atmospheric air to flow down the tubes to the propeller stream, thereby enabling the propellers to produce more thrust and get the boat "out-of-the-hole" and up to planing speed. At planing speed, the air-flow control valves are closed as cavitation is not a problem at planing speeds. It will be understood that any type of gas flowing down the tubes would control cavitation. Also, a blower may be used to force such gases down the tubes. Such problem of getting the boat "out-of-the-hole" is somewhat analogous to starting a car in high gear.

The concept of flat propeller angle necessitates the utilization of surface-piercing type propellers which operate partially in air when the boat is planing. A portion of the propeller turns through the displaced medium of the vessel (air). The propellers are then self-cavitating, but become very efficient devices as the entry velocity of air and water increases.

The two-speed concept also enables the utilization of a lower gear to accelerate large propellers and shift to high gear for optimum top speed. Otherwise, the propeller torque curve in displacement condition would exceed engine torque curve.

Other objects and advantages of the invention will be apparent from the following description taken in conjunction with the drawings wherein:

BRIEF DESCRIPTION OF THE DRAWINGS

In the drawings, like numbers and letters are used to identify like and similar parts throughout the several views.

DESCRIPTION OF THE PREFERRED EMBODIMENTS

Figure 1:
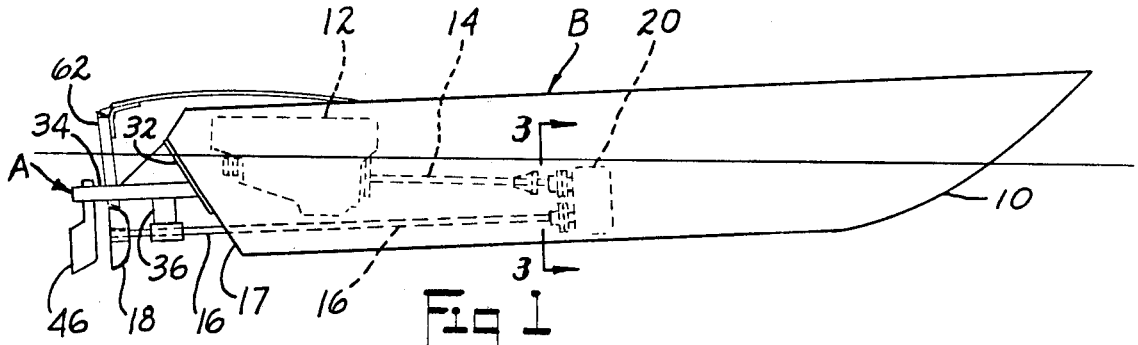
FIG. 1 is a side elevational view of a high performance speedboat of the invention, with the motor and drive train being shown in dashed lines, and showing the boat at rest in the water in its "in-the-hole" position.

Referring first to FIG. 1, there is shown a high-performance, inboard speedboat, constructed in accordance with the invention, and generally referred to as B. The boat B includes the planing type hull 10 containing the engine 12 which has a forwardly extending driveshaft 14. The engine 12 is disposed aft in the boat to achieve optimum planing when the boat travels at planing speeds. A propeller shaft 16 is disposed generally longitudinally in the boat and extends rearwardly through the boat transom 17 and contains an appropriate propeller 18 on its outer end.

Figure 3:
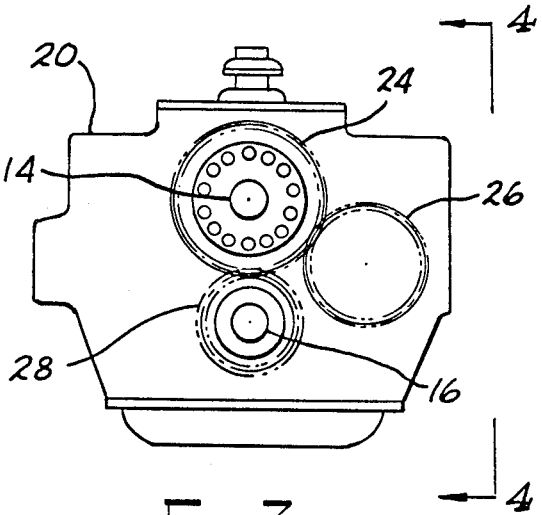
FIG. 3 is an enlarged view of the V-drive type transmission taken along the line 3—3 of FIG. 1.
Figure 4:
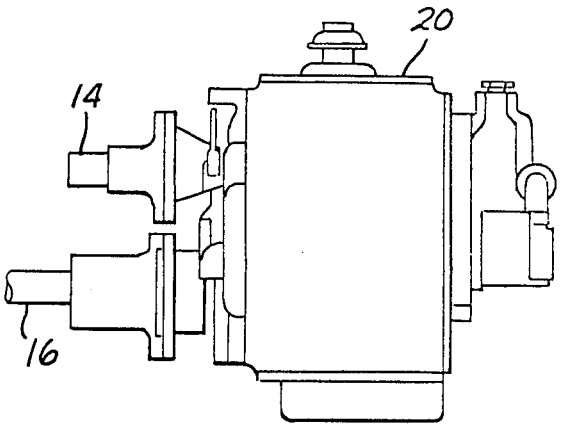
FIG. 4 is a view taken along the line 4—4 of FIG. 3.

Referring now to the "thru-drive" system components as best shown in FIGS. 1, 3 and 4, disposed forwardly of the engine 12 is a two-speed-forward, step-up, V-gear, hydraulic transmission 20 (with or without reverse) which operatively connects the engine driveshaft 14 and the propeller shaft 16 in V-drive structure. As aforementioned, a V-drive allows the engine to be installed aft in the boat for optimum planing and, additionally, effects a very small acute angle between the engine driveshaft and the propeller shaft (such as, for example, five to ten degrees), whereby the propeller shaft is substantially parallel to the longitudinal axis of the boat and thus extends out the boat transom 17 so that the propeller 18 can provide maximum thrust, thereby providing a "thru-drive" system.

The transmission 20 is a two-speed-forward transmission containing a low gear 24, and a high gear 26, each selectively meshing with the output gear 28, although, as aforementioned, it may be one, two or more speeds forward with or without reverse. It is to be particularly noted that such gearing is "step-up" gearing in that the propeller shaft 16 always revolves faster than the engine driveshaft 14 for maximum efficiency.

Figure 6:
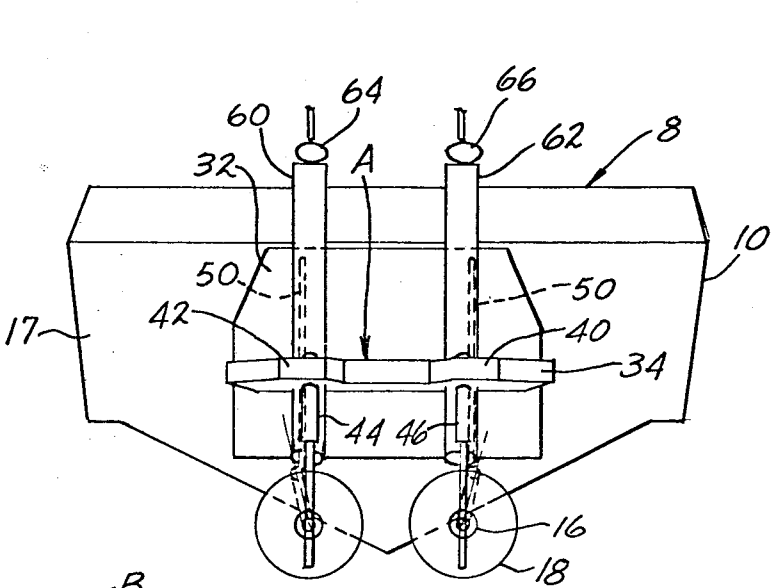
FIG. 6 is a view taken along the line 6—6 of FIG. 5.

Another integral feature of the invention is the unitary strut and steering support assembly (FIGS. 5, 6 and 7), generally referred to as A. The assembly A is secured to the boat transom 17 by any suitable means such as, for example, the bolts 30 and 31. The assembly A includes, as main components, the generally planar transom member 32 which is bolted to the transom 17, the generally horizontal rearwardly extending structural member 34 which is secured (preferably by welding) to the transom member 32, and a pair of spaced, downwardly extending prop strut support members of which only strut 36 is shown.

Figure 7:
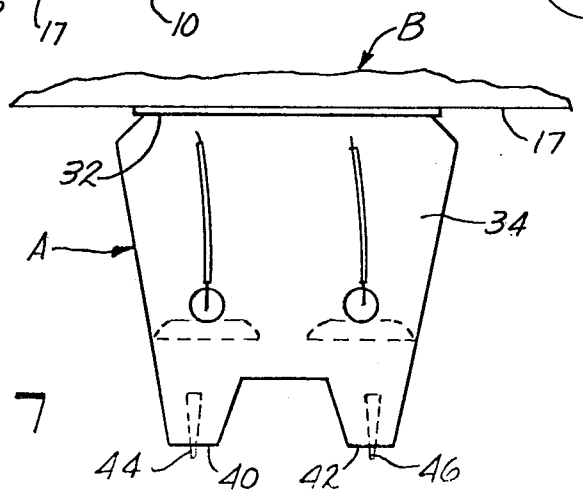
FIG. 7 is a top plan view of the structure shown in FIG. 5.
Figure 13:
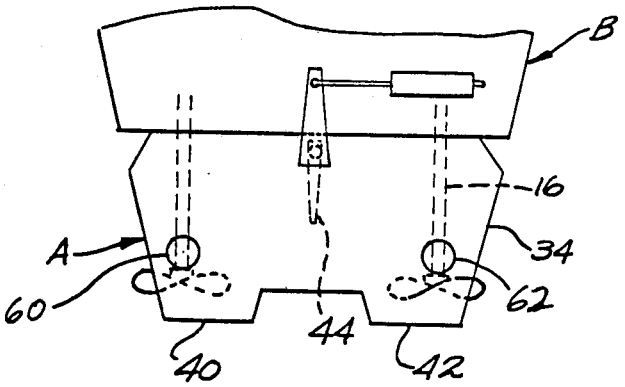
FIG. 13 is a plan view of a high performance speedboat of the invention and showing a single rudder.

The elongated structural member 34 is bifurcated (as best shown in FIG. 7) and has a pair of spaced rear end portions 40 and 42 each operatively supporting the rudder assemblies 44 and 46, respectively, thereon. It will be understood however, that only one rudder assembly many be used disposed on the stern of the boat as shown in FIG. 13.

Likewise, the strut support members operatively support the propeller shafts. For example, the strut 36 supports the propeller shaft 16.

The juncture of the structural member 34 with the transom member 32 is preferably reinforced by the spaced reinforcing members 50 and 52, which are preferably welded to the members 34 and 32.

Thus, the invention provides the one-piece unitary propeller strut and stern steering support assembly A capable of easy mounting, removal and replacement. The assembly is also capable of easy manufacture, assembly, maintenance and inspection.

Figure 5:
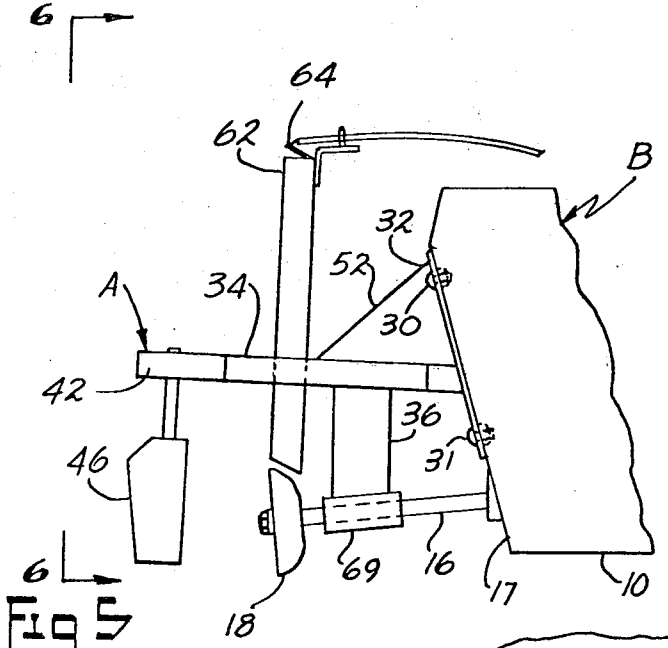
FIG. 5 is an enlarged view of the stern structure of the boat shown in FIG. 1.
Figure 8:
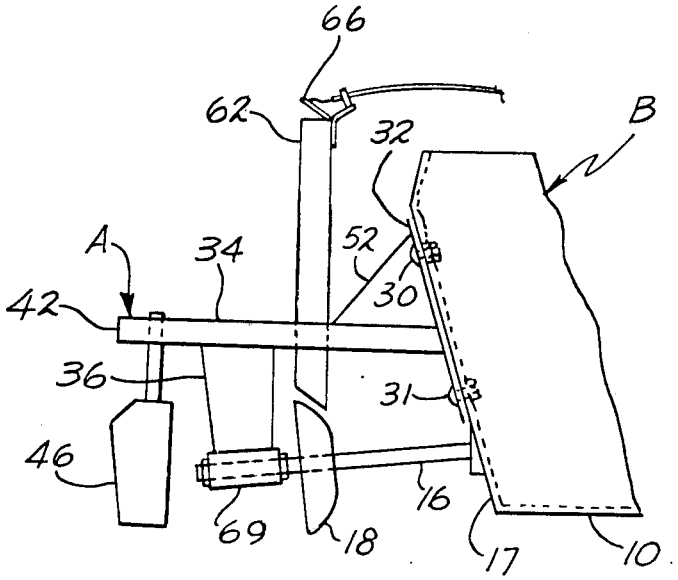
FIG. 8 is a view similar to FIG. 5, but showing a modification thereof.

It will be noted in FIG. 5 that the propeller 18 is rearwardly of the strut 36. In the FIG. 8 modification, the propeller is forwardly of the strut 36, which may be required if hull and engine characteristics so dictate. Also, the rudders may be positioned forward or aft of the propellers and the rudders may be secured to and part of the assembly A.

Figure 9:
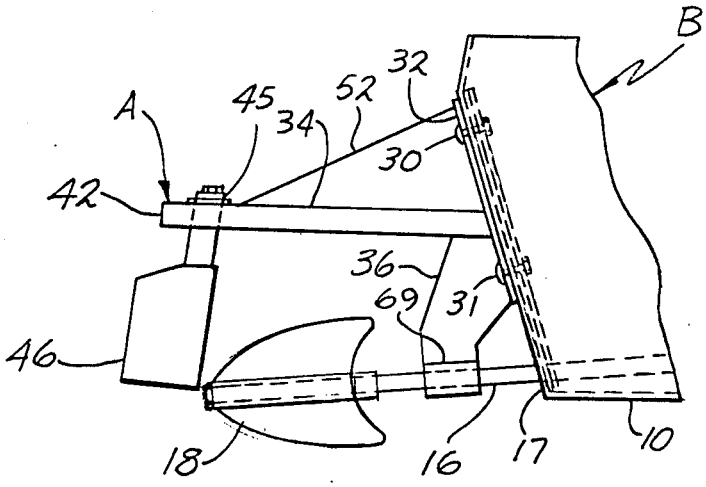
FIG. 9 is a view similar to FIG. 5, but showing a further modification thereof.
Figure 10:
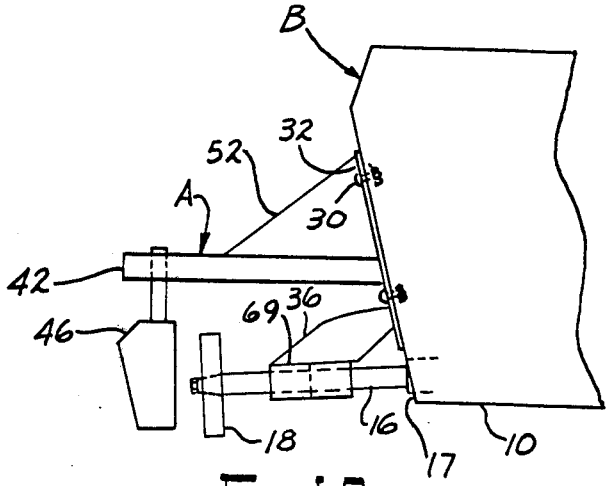
FIG. 10 is a view similar to FIG. 5, but showing a still further modification thereof.

In the FIG. 9 modification, the strut 36 is secured to both the transom member 32 and the structural member 34. In the FIG. 10 structure, the strut 36 is secured only to the transom member.

Figure 11:
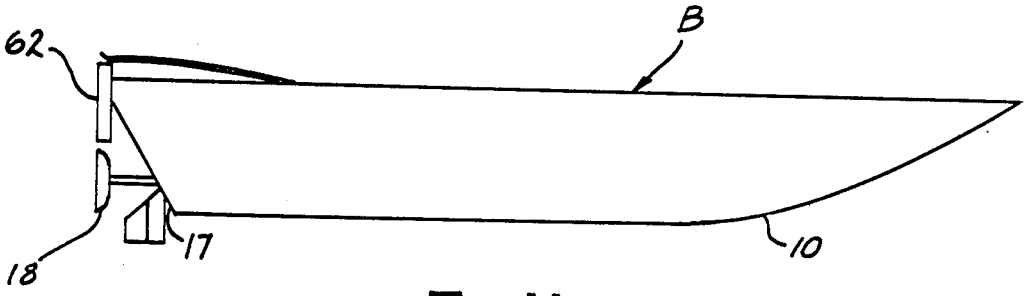
FIG. 11 is a view similar to FIG. 2, but showing a modification thereof.
Figure 12:
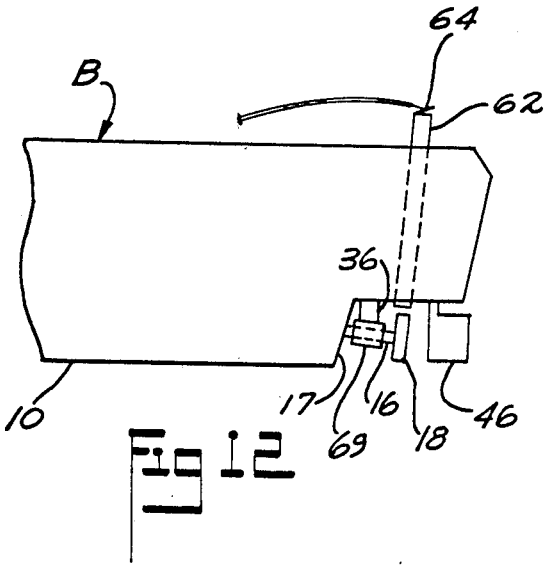
FIG. 12 is a side elevational view of a high performance speedboat of the invention incorporating a modified, off-set transom, with the air modulator extending down in the off-set portion.
Figure 14:
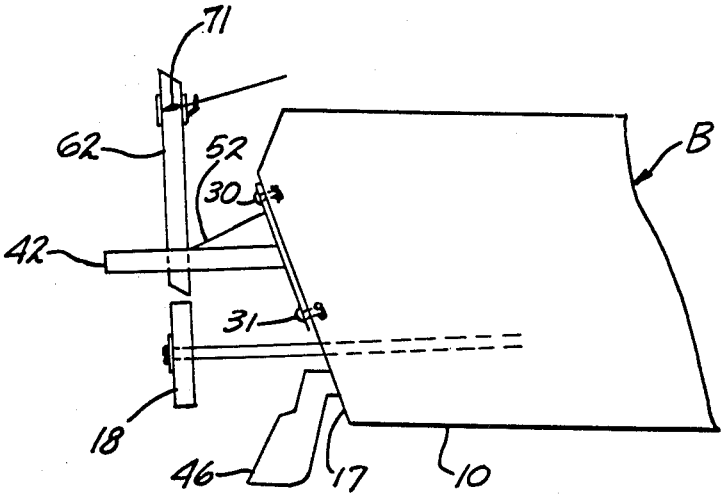
FIG. 14 is a side elevational view of a high performance speedboat of the invention and showing a modified type of air flow control valve on the air modulator.

To control cavitation, a pair of elongated, open-ended, hollow, generally vertical tubes 60 and 62 (FIG. 6) are provided on the stern of the boat which extend through at least a portion of the structural member 34 with their lower ends spaced slightly from their respective propellers and with their upper ends extending above the waterline as shown in FIG. 1. When the boat is in operation, air is drawn from the atmosphere and down the tubes 60, 62, to the propellers and into the propeller stream by the action of the propellers to control propeller stream cavitation. The tubes have (air flow control) flap valves 64, 66, respectively, at their top ends to control the flow of air through the tubes. It will be understood that any type of air flow control valve may be used to control air flow through the tubes 60 and 62 such as the slide type valve 71 of FIG. 14. Such tubes may be secured directly to the stern of the boat as shown in FIG. 11 or in any other position in the boat so long as a controlled flow of air is fed to the propellers. For example, FIG. 12 shows the tubes extending down into an off-set transom.

In operation, the boat is initially brought up to a speed of six to twelve miles per hour at which speed the boat is still "in-the-hole", as aforementioned. To get the boat "out-of-the-hole", the tube control valves 64, 66 are opened permitting atmospheric air to flow down the tubes to the propeller stream, thereby enabling the propellers to produce more thrust and get the boat "out-of-the-hole" and up to planing speed. At planing speed, the control valves 64, 66 are closed.

When the transmissions are engaged, the throttles are slowly opened thereby increasing the speed of the engines. At a certain engine rpm and boat speed (about six to twelve miles per hour), the "vital signs" become stable, i.e. the boat will move no faster nor will the engine rpm increase due to the resistance encountered by the propellers, and the boat is still "in-the-hole". This is due to uncontrolled cavitation and also to the fact that the propellers are encountering too much resistance due to the inherent design characteristics of the hull and propellers. To overcome this resistance, the tubes or air modulators 60, 62 are opened to allow atmospheric air to flow down the tubes to a very close proximity to the propellers. This air can either be drawn down the tubes to the rotating propellers, or if need be, forced down with a mechanical blower, exhaust or otherwise. Once the air is made available, it mixes with the water, thereby lessening the resistance at the propeller. This in turn, will let the propellers start to rotate faster and if the propellers are sized properly, will propel the boat forward and get the boat "out-of-the-hole" and up to planing speed.

Figure 2:
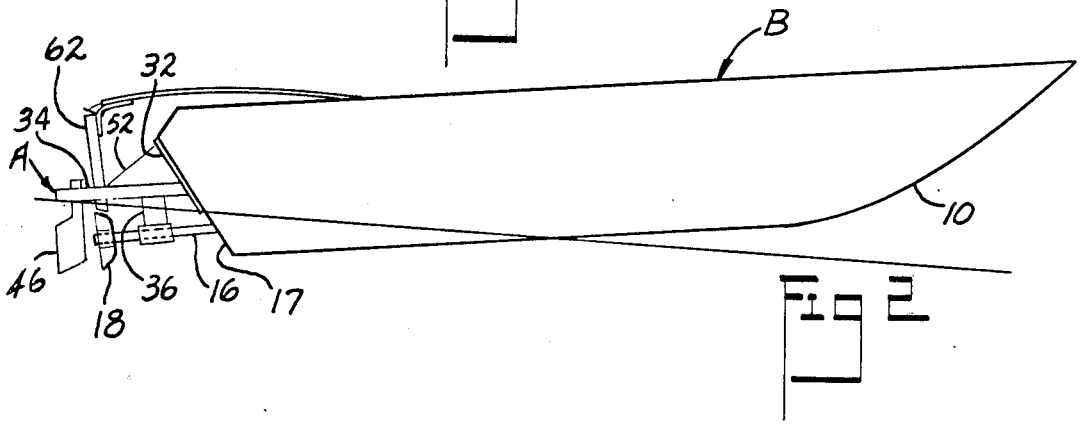
FIG. 2 is a view similar to FIG. 1, but showing the boat "out-of-the-hole" and in planing position in the water.

Once the boat is "out-of-the-hole" and up to planing speed as shown in FIG. 2, the problem becomes one of too little resistance. In other words, the propellers start to aerate excessively (not enough water). To control this situation, the air modulators 60, 62 are closed so that no air can come down the tubes. At this point, the correct set of variables are present, and forward thrust is maximized due to propeller speed.

The key is to aerate the water that surrounds the propeller while getting the boat "out-of-the-hole", and not increase the amount of aeration when the boat reaches planing speed.

Thus, the invention provides a drive mechanism for a propeller driven speedboat B having a planing type hull 10 with a transom 17 including drive means 12 having a driveshaft 14 extending therefrom, a propeller shaft 16 extending longitudinally through the boat and through the transom 17 and having a propeller 18 on its outer end, and a coacting two-speed-forward, step-up, hydraulic transmission 20 operatively connecting the driveshaft 14 and the propeller shaft 16. The transmission 20 includes V-drive gearing operatively connecting the driveshaft 14 and the propeller shaft 16, thereby effecting a V-drive structure for the drive mechanism. Any suitable marine drive means may be used such as, for example, a diesel engine.

Air flow means 60, 62 is provided for feeding a flow of gas (such as air) to the propeller when the boat is in operation. Coacting air control means 64, 66 is disposed in the tubes for selectively controlling the flow of air through the tubes.

The invention also provides an inboard motorboat one-piece, unitary strut and stern steering support assembly A for placement on the transom 17 of an inboard motorboat B including a transom member 32, means 30, 31 for securing the transom 32 to the boat transom 17, an elongated structural member 34 secured to the transom member 17 intermediate its top and bottom edges and extending rearwardly therefrom and having at least one rudder support means 45 (FIG. 9) operatively disposed on the structural member 34 intermediate the forward and rearward edges thereof for operatively receiving a rudder assembly 46 therein, at least one strut support member 36 secured to and extending downwardly from the structural member 34 and having a propeller shaft support means or bearing 69 on its lower end for operatively supporting an associated propeller shaft 16, said associated propeller shaft 16 having a propeller 18 thereon, and air flow means 60, 62 for feeding a flow of air to the propeller when the boat is in operation to control propeller stream cavitation.

Although the invention is shown and described herein as applied to a twin-engine, twin-propeller inboard motorboat, it is to be understood that it may be applied to single engine and single propeller inboard motorboats.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. A drive and steering mechanism for a propeller drive inboard speedboat having a planing type hull with a transom comprising; drive means having a driveshaft extending therefrom, a coacting propeller shaft extending longitudinally through the boat and through a portion of the transom and having a propeller on its outer end, a coacting at least one-speed forward, step-up, hydraulic transmission operatively connecting said driveshaft and said propeller shaft, whereby the propeller shaft revolves faster than the driveshaft, said transmission including a coacting V-drive gearing operatively connecting said driveshaft and said propeller shaft, thereby effecting a V-drive structure for the drive mechanism, a coacting one-piece, unitary strut and stern steering support assembly for placement directly on the transom of an inboard motorboat comprising, a coacting transom member, means for securing the transom member to the boat transom, a coacting elongated planar structural member secured to the transom member in substantially the central portion of the transom member between its top and bottom edges and extending rearwardly therefrom and having a pair of coacting spaced rudder support means operatively disposed on and solely supported by said structural member intermediate the forward and rearward edges thereof for operatively receiving rudder assemblies therein, a pair of coacting spaced strut support members secured to the structural member and extending downwardly therefrom forwardly of the propeller and having coacting propeller shaft support means for operatively receiving associated propeller shafts therein, a pair of coacting spaced reinforcing members secured to the structural member and to the transom member for reinforcing the juncture of such latter members, a coacting elongated open-ended linear tube disposed on the stern of the boat with its lower end spaced directly above and slightly from the propeller and with its upper end extending in a straight line to above the waterline, whereby as the boat is in operation air is drawn from the atmosphere and drawn down said tube to the propeller and into the propeller stream to control propeller stream cavitation, and a manually-operated valve operatively disposed at the top end of said tube and adapted to selectively close the top end of the tube for selectively controlling the flow of air through the tube.

* * * * *